United States Patent [19]

Kusayama

[11] Patent Number: 5,025,535

[45] Date of Patent: Jun. 25, 1991

[54] BOTTOM END STOP FOR SLIDE FASTENER

[75] Inventor: Masahiro Kusayama, Kurobe, Japan

[73] Assignee: Yoshida Kogyo, K. K., Tokyo, Japan

[21] Appl. No.: 476,613

[22] Filed: Feb. 7, 1990

[30] Foreign Application Priority Data

Feb. 16, 1989 [JP] Japan ..... 1-17069[U]

[51] Int. Cl.[5] ..... A44B 19/38

[52] U.S. Cl. ..... 24/433; 24/388

[58] Field of Search ..... 24/433, 434, 435, 436, 24/381, 388, 389

[56] References Cited

U.S. PATENT DOCUMENTS 3,858,283 1/1975 Runnels ..... 24/388
3,959,858 6/1976 Fukuroi ..... 24/435
4,571,785 2/1986 Akashi ..... 24/433
4,586,220 5/1986 Ogura et al. ..... 24/433

FOREIGN PATENT DOCUMENTS 0658650 10/1951 United Kingdom ..... 24/433

*Primary Examiner*—Victor N. Sakran
*Attorney, Agent, or Firm*—Hill, Van Santen, Steadman & Simpson

[57] ABSTRACT

A bottom end stop for a slide fastener is disclosed, which is formed by injection molding of a plastics material into a multi-shape structure designed to eliminate unintentional separation or "chain crack" of the fastener which would otherwise take place at the joint between the end stop and an endmost or terminal one of discrete coupling elements when upwardly directed thrust force is exerted from under the fastener.

5 Claims, 3 Drawing Sheets

BOTTOM END STOP FOR SLIDE FASTENER

BACKGROUND OF THE INVENTION

1. Field of the Invention

This invention relates generally to slide fasteners and particularly to a bottom end stop therefor which is adapted to restrict the movement of a slider at a bottom or lower end of the fastener.

2. Prior Art

There are known various forms of a row of coupling elements attached to a pair of stringer tapes, which elements are formed by injection molding of a synthetic resin into discrete individual structures each having a coupling head portion with an engaging recess in front, a barrel portion and a heel portion. A row of such coupling elements is mounted with their barrel portions astride a longitudinal edge of each of a pair of stringer tapes so that their coupling head portions protrude beyond the tape edge for interengagement with corresponding head portions on an opposed companion stringer tape. More specifically, the coupling element includes a narrow neck portion intermediate between the coupling head portion and the barrel portion and a pair of shoulder portions located on opposite sides of the neck portion and having respective engaging ribs engageable with the engaging recesses in the neighboring elements.

A typical example of a bottom end stop for use with coupling elements of the above construction is disclosed in Japanese Laid Open Utility Model Publication No. 56-37605, which end stop is attached to a pair of stringer tapes at one end thereof in such a manner that it merely overlies and joint part of both the coupling head and heel portions of a terminal one of the coupling elements.

Slide fasteners having the above described coupling elements may be effective for eliminating separation or a so-called "chain crack" of the two interengaged stringers which would take place when the fastener is subjected to upwardly directed thrust or stresses exerted for example from inside a bag fully loaded and tightly closed by the slide fastener. The prior art bottom end stop has a drawback in that since it is simply connected in overlying relation to a terminal or endmost coupling element, the "chain crack" is prone to occur at and from between that particular terminal element and the end stop when the slide fastener receives an external thrust force tending to split the two engaged stringers of the fastener.

It may be theoretically possible to preclude the problem of "chain crack" with the afore-mentioned type of slide fastener by providing a bottom end stop wilt an extra portion engageable with the engaging rib of the terminal coupling element. However, in as much as such end stops are mostly injection-molded, a hot melt of plastics material in the cavity of the mold tends to leak from the engaging recess in the coupling element and fill up between the coupling head portion of a terminal element and the neck portion of an adjoining coupling element, rendering it difficult to open or close the fasteners.

SUMMARY OF THE INVENTION

It is therefore the primary object of the present invention to provide a bottom end stop for a slide fastener which will eliminate the foregoing difficulties of the prior art.

A more specific object of the invention is to provide a bottom end stop which can be injection-molded, without encountering leakage of a hot melt of molding material, into a desired form highly resistant to external thrust force and hence to the tendency of unintentional separation or "chain crack" of a slide fastener to which the end step is applied.

These objects and other features of the invention will be better understood from the following detailed description taken in conjunction with the accompanying drawings.

According to the invention, there is provided a slide fastener comprising a pair of stringer tapes, a row of discretely arranged coupling elements secured to and along a longitudinal inner edge of each of the tapes and a slider reciprocally movable along the rows of the coupling elements, each of the coupling elements having a bulged coupling head with an engaging recess formed in its front end, a reduced neck, a barrel with a slot formed therein for mounting the element astride the tape inner edge, shoulders formed between the neck and the barrel, a pair of engaging ribs projecting from the respective shoulders toward the head and a pair of heels extending from the rear end of the barrel, a bottom end stop secured to the bottom end portions of the respective tapes and adapted to restrict thereat the movement of the slider, the bottom end stop having forked portions defining therebetween a bay for receiving the coupling head of a terminal element and a recess formed in the forked portion for receiving the engaging rib of the terminal element, the forked portion forming a protuberance which extends between the neck and the head of the terminal element.

DETAILED DESCRIPTION OF THE INVENTION

Figure 6:
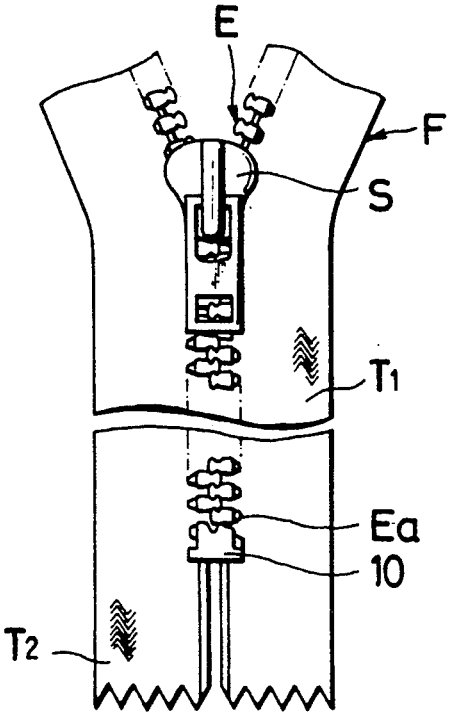
FIG. 6 is a plan view of a slide fastener carrying the bottom end stop of the invention to restrict the movement of a slider.

Referring now to the drawings and firstly to FIG. 6, there is shown a slide fastener F which comprises a pair of stringer tapes $T_1$ and $T_2$, a row of discretely arranged coupling elements E secured to and along a longitudinal inner or beaded edge Ta, (Tb) of each of the tapes $T_1$, $T_2$ and a slider S reciprocally movable over and along the rows of coupling elements E to take the latter into and out of engagement with each other so as to close and open the slide fastener F in a manner well known in the art.

A bottom end stop 10 embodying the invention is secured to the bottom or lower end portions of the respective tapes $T_1$ and $T_2$ and adapted to restrict or limit thereat the movement of the slider S.

Figure 5:
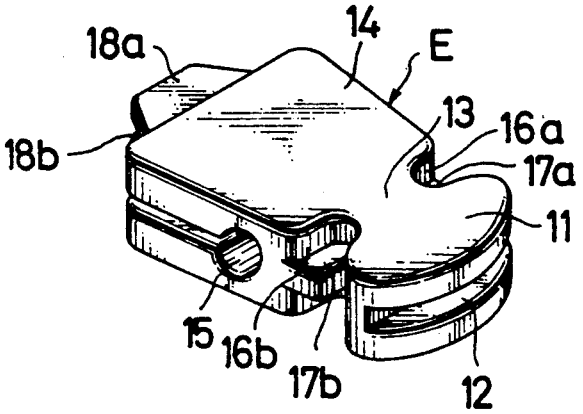
FIG. 5 is a perspective view of a coupling element to which the end of the invention is applied.

A single unit coupling element E, with which the end stop 10 of the invention is associated, is shown in FIG. 5. The element E is formed by injection-molding of a plastic material into a multi-shape structure having a bulged coupling head 11 with an engaging recess 12 formed in its front end, a reduced neck 13, a generally square barrel 14 with a slot 15 formed therein for mounting the element E astride the inner edge of the tape $T_1$ ($T_2$), shoulders 16*a*, 16*b* formed between the neck 13 and the front end of the barrel 14, a pair of engaging ribs 17*a*, 17*b*, projecting from the respective shoulders 16*a*, 16*b* toward the head 11 and adapted to engage with the recesses 12 of two neighboring elements E and a pair of heels 18*a*, 18*b* extending from the rear end of the barrel 14 and adapted as a guide rail for the slider S.

Figure 1:
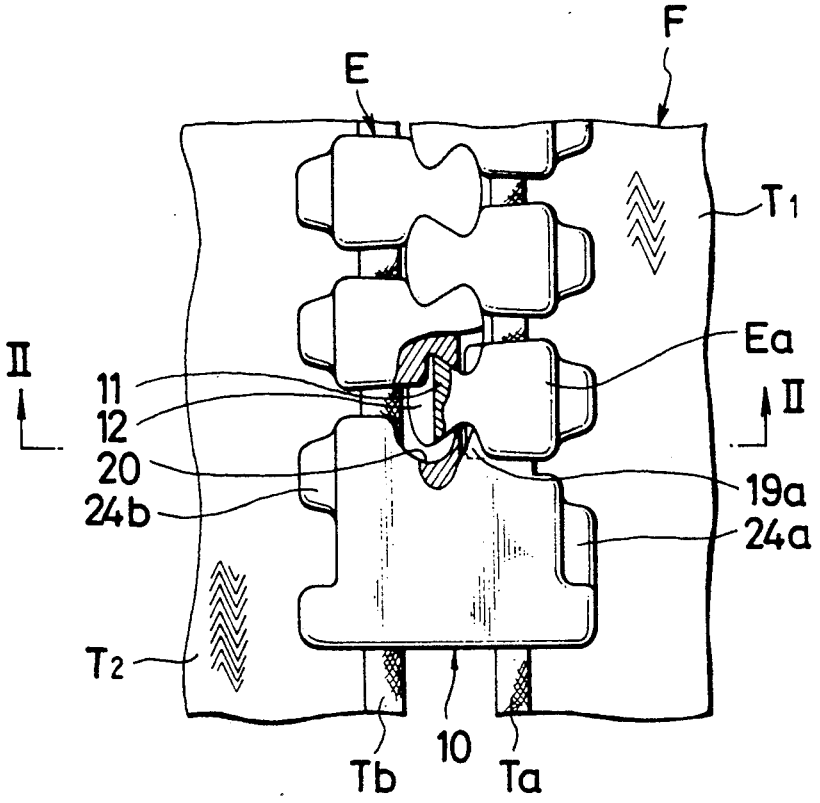
FIG. 1 is a fragmentary plan view of a slide fastener having a bottom end stop embodying the invention.
Figure 2:
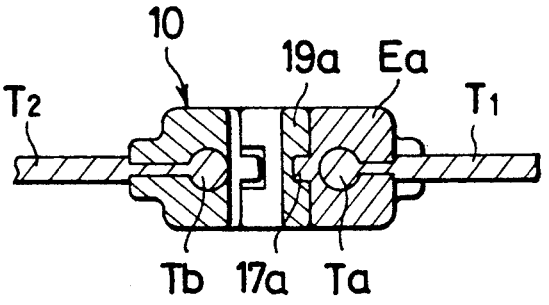
FIG. 2 is a cross-sectional view taken on the line II —II of FIG. 1.
Figure 3:
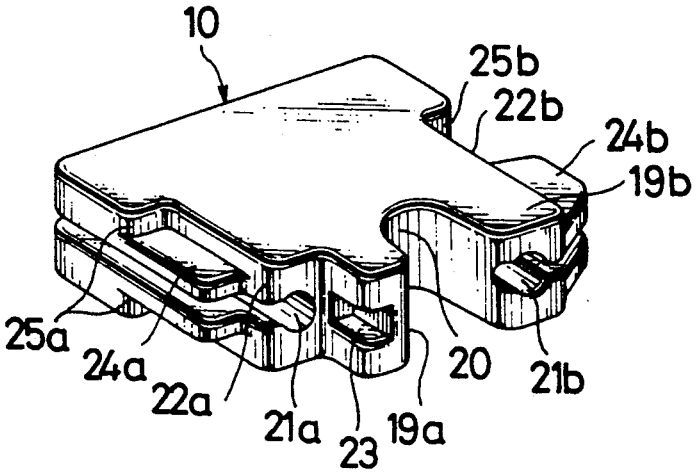
FIG. 3 is a perspective view of the bottom end stop shown in FIG 1.

Referring now to FIGS. 1–3 shows a bottom end stop 10 provided in accordance with the invention. The end stop 10 is in the form of a generally rectangular block and has forked portions 19*a*, 19*b* at one of its ends defining therebetween a bay 20 for receiving the coupling head 11 of a terminal or endmost element Ea. As better shown in FIG. 3, the end stop 10 is provided with longitudinal slots 21*a*, 21*b* formed in opposite side walls 22*a*, 22*b* for receiving the beaded edges Ta, Tb of the respective stringer tapes $T_1$, $T_2$ and with a recess 23 in the forked portion 19*a* for receiving the engaging rib 17*a* of the terminal coupling element Ea. The forked portion 19*a* itself forms a protuberance which extends and fits into the space between the neck 13 and the head 11 of the terminal element Ea. Designated at 24*a* and 24*b* are guide rails similar to and aligned with the heels 18*a* and 18*b* of the coupling elements E for guided sliding engagement with the side flanges of the slider S. The guide rails 24*a* and 24*b* terminate at abutments 25*a* and 25*b* respectively, which are formed on opposite sides of the end stop 10 for abutting engagement with the rear end of the slider S to arrest the latter there in place.

Figure 4:
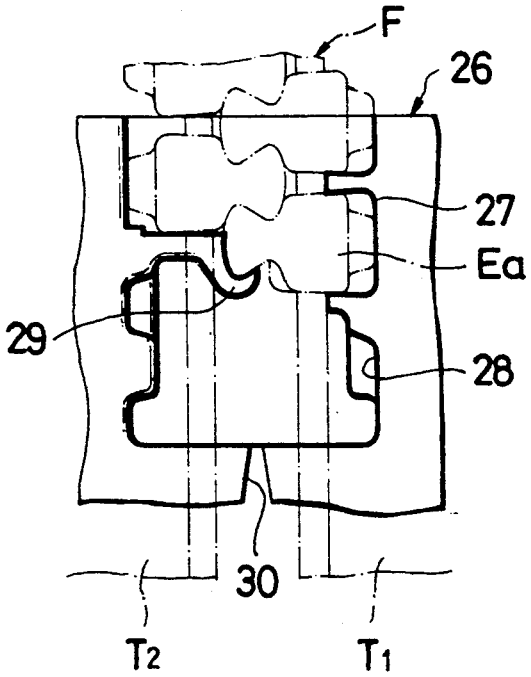
FIG. 4 is a schematic plan view showing a lower half of a mold use form the end stop of the invention.

FIG. 4 schematically illustrates an injection mold 26 (a lower half part thereof) which may be utilized to form the bottom end stop 10 according to the invention. Prior to the molding operation, a lower end portion of a chain of slide fastener stringers including two to three initial coupling elements E is placed in a non-molding recess 27 of the mold 26.

A molding cavity 28 contiguous to the non-molding recess 27 opens partly into the terminal element Ea so that the forked portion or protuberance 19*a* of the bottom end stop 10 is formed by the reduced neck 13 of the terminal element Ea. The cavity 28 has a hook-shaped partition 29 for forming the bay 20 of the end stop 10 and for peripherally encompassing the major portion of the bulged head 11 of the terminal element Ea so as to isolate the engaging recess 12 in the head 11 thereby eliminating the penetration or leak of the molding material into the succeeding elements E. The end stop 10 is thus formed by introducing a hot melt of plastics material into the mold 26 via gate 30.

Obviously, various modifications and variations of the present invention are possible in the light of the above teaching. It is therefore to be understood that within the scope of the appended claims the invention may be practiced otherwise than as specifically described.

What is claimed is:

1. In a slide fastener comprising a pair of stringer tapes, a row of discretely arranged coupling elements secured to and along a longitudinal inner edge of each of the tapes and a slider reciprocally movable along the rows of said coupling elements, each of said coupling elements having a bulged coupling head with an engaging recess formed in its front end, a reduced neck, a barrel with a slot formed therein for mounting said element astride said tape inner edge, shoulders formed between said neck and said barrel, a pair of engaging ribs projecting from said shoulders respectively, toward said head and a pair of heels extending from the rear end of said barrel, a bottom end stop secured to the bottom end portions of the respective tapes and adapted to restrict thereat the movement of said slider, said bottom end stop having forked portions defining therebetween a bay for receiving the coupling head of a terminal element and a recess formed in said forked portion for receiving the engaging rib of said terminal element, said forked portion forming a protuberance which extends between said neck and said head of said terminal element.

2. A bottom end stop according to claim 1 further including longitudinal slots in opposite sides thereof for receiving the inner edges of said tapes.

3. A bottom end stop according to claim 1 further including guide rails similar to and aligned with the heels of said coupling elements for guided engagement with said slider.

4. A bottom end stop according to claim 1 further including abutments at which said guide rails respectively terminate and which are abuttingly engageable with the rear end of said slider to arrest the latter in place.

5. A bottom end stop according to claim 1 which is formed by injection molding of a plastics material.

* * * * *